US005558334A

United States Patent [19]

Roche

[11] Patent Number: 5,558,334

[45] Date of Patent: Sep. 24, 1996

[54] GOLF TEE PLATFORM

[76] Inventor: Mortimer P. Roche, 8516 Blounts La., Fulton, Md. 20759

[21] Appl. No.: 515,914

[22] Filed: Aug. 16, 1995

[51] Int. Cl.[6] ..... A63B 69/36

[52] U.S. Cl. ..... 473/279

[58] Field of Search ..... 273/195 A, 195 B, 273/176 H, 176; 434/252

[56] References Cited

U.S. PATENT DOCUMENTS

| | | | |
|---|---|---|---|
| D. 267,739 | 1/1983 | Hughes | D21/234 |
| D. 275,413 | 9/1984 | Shroads et al. | D21/234 |
| 2,668,711 | 2/1954 | McLaughlin | 273/195 A |
| 3,633,917 | 1/1972 | Anderson | 273/176 H X |
| 3,693,979 | 9/1972 | Koett | 273/195 B |
| 4,146,231 | 3/1979 | Merkle et al. | 273/187 R |
| 4,875,684 | 10/1989 | Benilan | 273/195 B |
| 5,005,837 | 4/1991 | Martinez | 273/176 H |
| 5,340,111 | 8/1994 | Froelich | 273/195 B |
| 5,358,251 | 10/1994 | Ashton | 273/195 B |

OTHER PUBLICATIONS

"Golf Jack" Brochure, Undated, Inventor–Spriddle.

*Primary Examiner*—George J. Marlo
*Attorney, Agent, or Firm*—Terrance L. Siemens

[57] ABSTRACT

An adjustably rotatable and inclined practice platform for golf swings. A circular playing surface is fixed to a vertical mast supported on a base. The playing surface is oriented at an angle to the mast. A motor and gearset revolve the practice platform as desired by the user. The playing surface comprises a plurality of pie slice shaped sections of artificial turf. Each section of turf is of a different turf height, so that the user can practice coping with different turf heights, in addition to varying inclinations of terrain. Preferably, the playing surface comprises a removable member secured to a plate permanently fixed to the mast. The circumference of the playing surface bears a succession of closely spaced holes for supporting golf tees. A skirt seals the open space below the platform, thereby protecting the motor and gearset.

10 Claims, 1 Drawing Sheet

GOLF TEE PLATFORM

BACKGROUND OF THE INVENTION

1. Field of the Invention

The present invention relates to a platform for practicing driving from golf tees. The platform has different areas simulating different ground conditions, and is rotatable so that a user can practice driving from a tee on any selected one of several varieties of ground conditions. Uphill and downhill inclination conditions can also be simulated.

2. Description of the Prior Art

On a golf course, driving from a tee is performed under an infinite number of conditions, with respect to height of the grass and inclination of the terrain. It may be that while a golfer can easily cope with certain combinations of conditions, he or she lacks sufficient skill or experience to cope with others. It would be desirable to be able to create specified conditions at will for practice.

One answer is to find the desired conditions on a course and practice driving. However, a course is likely to be in use, and such practice would shortly conflict with other golfers. By contrast, a driving range is intended for such practice. However, conditions at a driving range are fixed for each practice position. It is unlikely that particular desired terrain conditions will be encountered.

To answer this need, the prior art has developed adjustable platforms for practice. Some practice platforms are circular and adjustable as to rotation and also adjustable as to inclination. Examples are seen in U.S. Pat. No. 4,875,684, issued to Jacques Benilan on Oct. 24, 1989, U.S. Pat. No. 5,005,837, issued to Pedro M. Urra Martinez on Apr. 9, 1991, and U.S. Pat. No. 5,340,111, issued to David S. Froelich on Aug. 23, 1994.

The device of Urra Martinez both revolves and adjusts its inclination. The periphery of the circular is provided with regularly spaced apart locations for spotting golf balls. The golf balls may be struck from these locations, which are sufficiently numerous as to allow a significant number of balls to be struck prior to refilling the empty positions.

Froelich's practice platform provides synthetic turf in order to more closely simulate natural conditions. The opening beneath the platform of Froelich's device is sealed by a two part, overlapping skirt. However, neither the device of Urra Martinez nor the others provides a selection of turf or other surfaces having simulated grass of different heights, as is provided in the present invention.

U.S. Pat. No. 5,358,251, issued to James T. Ashton on Oct. 25, 1994, describes a platform which can be selectively inclined. A bellows type skirt seals the opening beneath the platform. Unlike the present invention, the platform is not rotatable, lacks a variety of turf heights, and does not have a peripheral pattern of holes for tees.

None of the above inventions and patents, taken either singly or in combination, is seen to describe the instant invention as claimed.

SUMMARY OF THE INVENTION

The present invention simulates a natural condition of golf courses which has not been addressed in the prior art. This condition is that of varying turf heights. Different turf heights occur even on well maintained golf courses since standards of turf height can vary.

Golf is an endeavor requiring concentration while executing maneuvers, such as driving and putting. These maneuvers are performed under varying conditions of terrain. The successful golfer must then learn to cope with these conditions. The conditions of inclination of terrain have been adequately addressed in prior art practice platforms. However, variable turf height conditions, which have the ability to influence the golfer's concentration and execution, have not been addressed. The present invention seeks to provide this aspect of practice in a device which is uncomplicated, rugged, and easily adjusted.

To these ends, the present invention comprises a platform fixed at an angle to a rotatable vertical mast. The mast is rotated by a motor so that with the golfer facing an open driving range, a selected inclination is appropriately oriented. The motor may be powered by a battery located in close proximity, or may be wired to a source of utility electrical power.

The surface of the platform is provided with pie slice sections of artificial turf of various turf heights. The surface is adjustable with respect to its underlying supporting member, so that a desired combination of simulated terrain inclination and turf height are easily achieved. The pie slice configuration is selected because when a circle is so divided, radial symmetry is obtained. Thus, despite rotation of the platform, a user remains at a constant orientation with respect to the driving range. The sections of the artificial turf are designed for the user to be able to drop or place the ball on. The user would then use irons or woods per turf condition giving more of a fairway situation. "Bringing the fairway to the driving range." In essence adding the challenge of hitting the ball in varying length turf.

The peripheral area of the circular platform is provided with a succession of holes for golf tees. The user places any desired number of tees in these holes. The platform is thus prepared for many swings in rapid succession, requiring little effort to prepare for each succeeding swing.

The platform and mast are supported on a base placed on the surrounding ground. Thus, the novel practice platform can be provided as a compact, unitary device which need merely be placed on the ground at a driving range.

The construction employing base and mast raises the platform off the ground, thereby exposing open space beneath the platform and also exposing the motor and gear works for rotating the platform. The open space is sealed by a pleated skirt. This protects the motor and gear works, improves the aesthetics of the platform, and prevents dropped golf balls from coming to rest inaccessibly beneath the platform.

Accordingly, it is a principal object of the invention to provide a golf swing practice platform which selectively simulates various turf heights.

It is another object of the invention that the practice platform be rotatable, so that the user is constantly oriented with respect to a driving range regardless of on which part of the platform he or she stands.

It is a further object of the invention that the practice platform selectively simulate various degrees of inclination of terrain.

Still another object of the invention is to enable adjustability of combinations of turf heights and inclination of terrain.

An additional object of the invention is to provide a unitary device which is erected by placing it on the ground.

It is again an object of the invention to accommodate a plurality of golf tees for preparing golf balls for striking from the practice platform.

Yet another object of the invention is to configure the platform surface to have sections of various turf heights arranged radially symmetrically on a circular platform.

Still another object of the invention is to seal an opening existing below the elevated practice platform and the ground.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
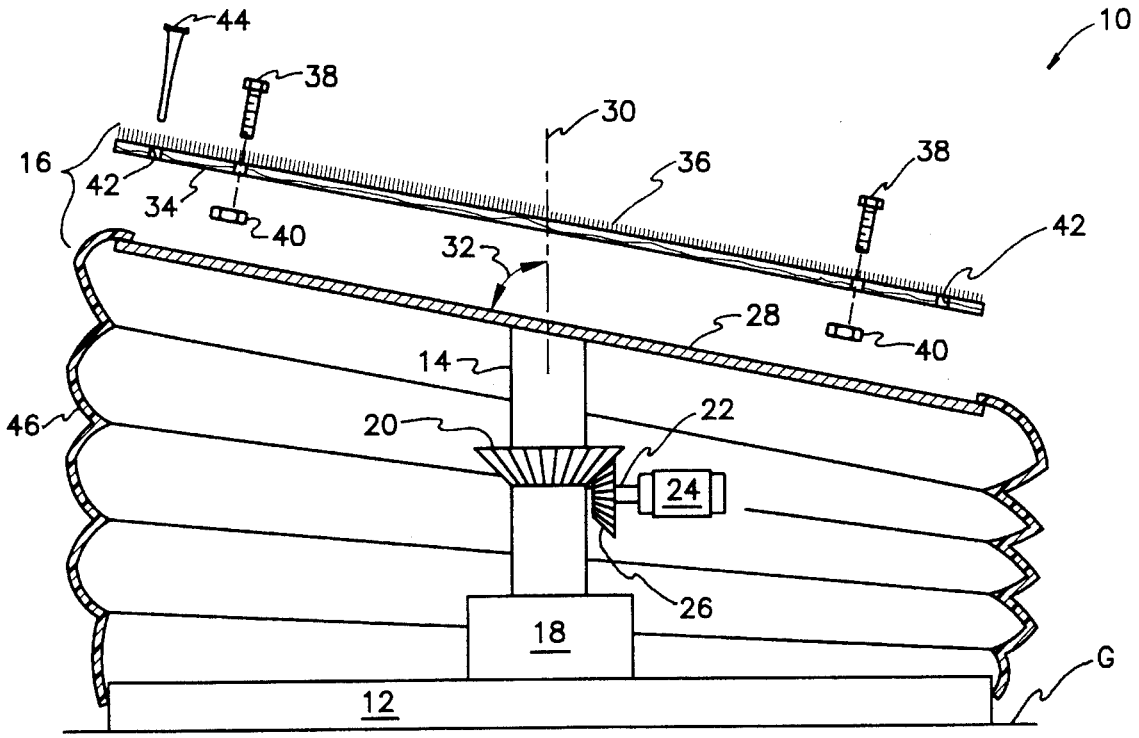
FIG. 1 is a side elevational, partially exploded, partially cross sectional view of the invention.

Turning now to FIG. 1 of the drawings, the novel practice platform 10 includes a base 12 for supporting practice platform 10 on the ground G, a vertical mast 14 rotatably supported on base 12, and a playing surface member 16 supported on mast 14.

Mast 14 is rotatably journaled or otherwise suitably supported within base 12 at 18. A gear 20 is circumferentially oriented about and fixed to mast 14. Output shaft 22 of a motor 24 engages gear 20 by a smaller gear 26. Playing surface member 16 is rotated by operating motor 24 by any suitable switch (not shown). Motor 24 is secured to base 12 by a suitable bracket (not shown), and is powered by battery or by wiring to utility electrical power (neither shown), as desired for the application.

Playing surface member 16 preferably comprises a sturdy support plate 28 fixed to mast 14. Mast 14 is vertical, and has a vertical axis 30. Support plate 28 is secured to mast 14 at an angle 32 to axis 30. Angle 32 preferably simulates that of ground inclination typically encountered on a golf course, and need not be any particular angle.

A playing surface liner 34 is removably secured to plate 28. Liner 34 bears sections of artificial turf 36, and is secured against movement relative to plate 28 by threaded fasteners 38 and associated nuts 40. Liner 34 may be fastened by any suitable method, but fasteners 38 are preferred since they are commonly available in standard sizes and require commonly available ordinary tools. Liner 34 also has holes 42 for insertion thereinto of golf tees 44.

Plate 28 is of rugged construction, and permanently fixed to mast 14. Liner 34 is preferably fabricated from plywood, or some similar material which is reasonably strong and light, easily drilled to form holes 44 and openings to accommodate fasteners 38, and to which artificial turf 36 is adhered or otherwise suitably attached.

Playing surface member 16, if not covered, would expose open space therebelow, and also expose motor 24 and its associated gears 20, 26. This space is sealed by a skirt 46 which depends from member 16. Skirt 46 protects motor 24, improves the aesthetics of practice platform 10, and prevents small objects such as dropped golf balls (not shown) from coming to rest beneath member 16.

Figure 2:
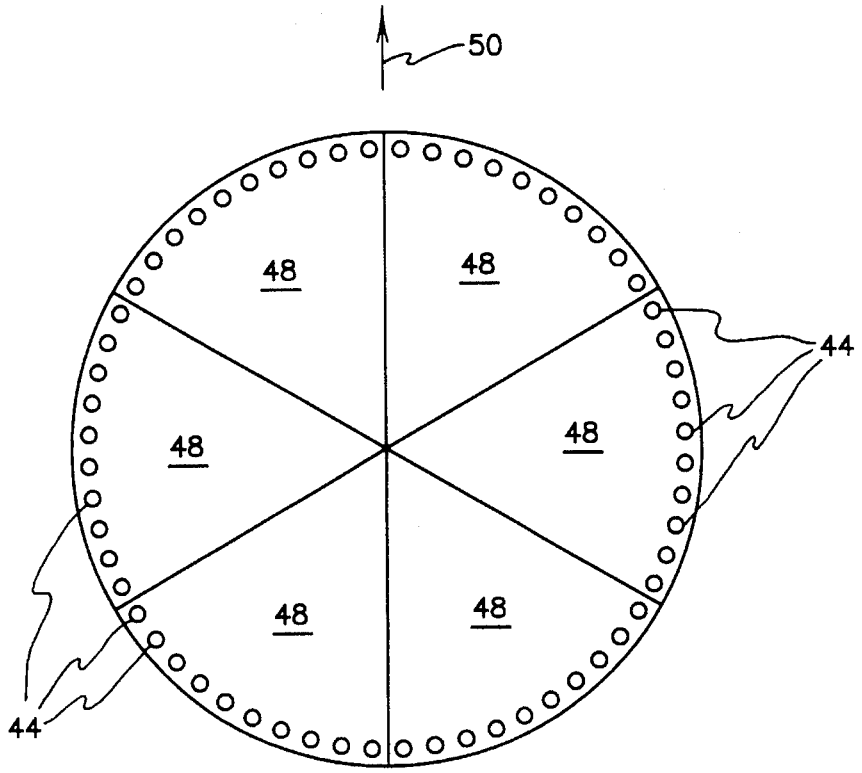
FIG. 2 is a diagrammatic top plan view of the invention, illustrating orientation of a user and the novel practice platform on a driving range.

FIG. 2 shows a critical property of artificial turf 36. Turf 36 is arranged in sections 48. Each section 48 has artificial turf of a different height than that of other sections 48, so that a golfer can select a particular turf height for his or her driving practice.

Each section 48 is configured as a pie slice, so that playing surface member 16 (see FIG. 1) will be radially symmetrical, as viewed from the top. When playing surface member 16 is rotated, the golfer will be able to maintain a consistent position on member 16, and will maintain constant orientation with respect to the driving range, indicated by arrow 50. This holds true regardless of which section 48 of turf 36 has been rotated to face the driving range. It is apparent from FIGS. 1 and 2 that all sections 48 of artificial turf 36 are coplanar, as they rest on plate 28, and are simultaneously accessible from the top of practice platform 10.

FIG. 2 also shows a preferred arrangement of holes 42. Holes 42 are located about and in close proximity to the circumference of member 16. They are spaced closely together and provided continuously at the circumference, so as to maximize the number of positions for golf tees 44. Again referring to FIG. 1, from time to time, it will be necessary to remove liner 34. For example, this may be required in order to achieve a desired combination of a particular section of turf 36 and a specific inclination angle 32. This is easily performed by unbolting liner 34, moving it to a new position, and refastening liner 34 to plate 28.

Another reason for removal of liner 34 is to renew turf 36, should that become frayed, torn, or otherwise damaged. Regardless of the reason for removal, liner 34 is preferably light yet strong so that it both performs its duties and is still light enough to be maneuverable.

It is to be understood that the present invention is not limited to the embodiments described above, but encompasses any and all embodiments within the scope of the following claims.

I claim:

1. A golf driving practice platform, comprising:

a base;

a vertical rotatable mast supported on said base, said mast having a gear circumferentially oriented thereon;

a motor for revolving said mast, said motor having an output shaft terminating in a second gear, said second gear engaging said gear of said mast; and a playing surface member supported on and rotatable with said mast, said playing surface member comprising a support plate fixed to said mast, and a playing surface liner having means for removable securement to said support plate, said playing surface liner having disposed thereon a plurality of sections simulating different ground conditions normally found on a golf course, said plurality of sections being generally coplanar and constantly upwardly exposed, whereby all sections are simultaneously accessible from above said practice platform.

2. The practice platform according to claim 1, said mast having a vertical axis, and said support plate of said playing surface member is fixed to said mast at an oblique angle to said vertical axis.

3. The practice platform according to claim 1, said playing surface member having a circumference and means defining a plurality of holes for supporting golf tees, said holes located about and in close proximity to said circumference of said playing surface member.

4. The practice platform according to claim 1, said plurality of sections simulating different ground conditions are of pie slice configuration wherein central points of each pie slice configuration meet generally at a common point, whereby said playing surface liner is radially symmetrical, whereby selective removal from said support plate, rotation of said playing surface liner about the common point, and reattachment of said liner to said plate, presents a different section simulating a different ground condition oriented such that a user's orientation on said practice platform with respect to a driving range may remain constant when using all said sections.

5. The practice platform according to claim 1, said playing surface member further comprising means for securing said surface liner against movement relative to said support plate, whereby said playing surface liner is readily installed on, rotated with respect to, and removed from said support plate.

6. The practice platform according to claim 5, said means for securing said surface liner against movement comprising threaded fasteners, whereby said playing surface liner is removed and installed with ordinary tools.

7. The practice platform according to claim 1, further comprising a skirt depending from said playing surface member, for sealing an open space existing below said playing surface member, thereby protecting said gear of said mast, said motor, and said second gear of said output shaft of said motor.

8. The practice platform according to claim 1, wherein said support plate is fixed to said mast at an oblique angle so that, as said mast is rotated, the slope of the support plate in a given fixed direction is variable so as to simulate uphill, downhill, and sidehill lies as commonly found on a golf course.

9. The practice platform according to claim 1, wherein individual ones of said plurality of sections of said playing surface liner are comprised of artificial turf of differing turf heights from one another.

10. A golf driving practice platform, comprising:

a base for supporting said practice platform on the ground;

a mast having a vertical axis, said mast having means for being rotatably supported on said base, and said mast having a gear circumferentially oriented thereon;

a motor for revolving said mast, said motor having an output shaft terminating in a second gear, said second gear engaging said gear of said mast;

a playing surface member supported on said mast and secured to said mast at an oblique angle to said vertical axis, said playing surface member comprising a support plate fixed to said mast, and a playing surface liner having means for removable securement to said support plate, said playing surface liner having a top and having disposed thereon a plurality of sections simulating different ground conditions normally found on a golf course, said plurality of sections being generally coplanar and constantly upwardly exposed, whereby all sections are simultaneously accessible from above said practice platform, said playing surface member having a circumference and means defining a plurality of holes for supporting golf tees, said holes located about and proximate to said circumference of said playing surface member, said playing surface member further comprising threaded fasteners for securing said playing surface liner to said support plate and for securing said surface liner against movement relative to said support plate, whereby said playing surface liner is readily removed from and installed with ordinary tools, said sections being of pie slice configuration wherein points of each pie slice configuration meet generally at a common point, whereby said playing surface liner is radially symmetrical, whereby selective removal from said support plate, rotation of said playing surface liner about the common point, and reattachment of said liner to said plate, presents a different section simulating a different ground condition oriented such that a user's orientation on said practice platform with respect to a driving range may remain constant when using all said sections; and a skirt depending from said playing surface member, for sealing an open space existing below said playing surface member, thereby protecting said gear of said mast, said motor, and said second gear of said output shaft of said motor.

* * * * *